United States Patent [19]

Gröner et al.

[11] Patent Number: 4,930,904

[45] Date of Patent: Jun. 5, 1990

[54] CROSS-BOTTOM OR BLOCK-BOTTOM VALVE SACK

[75] Inventors: Alois Gröner, Lengerich, Fed. Rep. of Germany; Fabien Rencurosi, Liége, Belgium

[73] Assignee: Bischof und Klein GmbH & Co., Lengerich, Fed. Rep. of Germany

[21] Appl. No.: 298,372

[22] Filed: Jan. 18, 1989

[30] Foreign Application Priority Data

Sep. 5, 1988 [DE] Fed. Rep. of Germany ... 8811184[U]

[51] Int. Cl.[5] ..... B65D 30/24

[52] U.S. Cl. ..... 383/45; 383/44; 383/48; 383/54; 383/56

[58] Field of Search ..... 383/45, 44, 46, 55, 383/56, 53, 54, 48

[56] References Cited

U.S. PATENT DOCUMENTS

| | | | |
|---|---|---|---|
| 2,105,376 | 1/1938 | Scott | 383/45 |
| 3,087,670 | 4/1963 | Rhodes | 383/56 |
| 4,071,187 | 1/1978 | La Fleur | 383/45 |
| 4,166,482 | 9/1979 | Sanders | 383/44 X |
| 4,367,620 | 1/1983 | Fox | 383/54 X |
| 4,412,645 | 11/1983 | Lepisto | 383/56 X |
| 4,759,640 | 7/1988 | Gröner | 383/44 |

FOREIGN PATENT DOCUMENTS

| | | | |
|---|---|---|---|
| 963745 | 5/1957 | Fed. Rep. of Germany | 383/53 |
| 1085027 | 7/1960 | Fed. Rep. of Germany | 383/45 |
| 2117301 | 12/1971 | Fed. Rep. of Germany | 383/54 |
| 631440 | 11/1949 | United Kingdom | 383/54 |

*Primary Examiner*—Stephen P. Garbe
*Assistant Examiner*—Jes F. Pascua
*Attorney, Agent, or Firm*—Jordan and Hamburg

[57] ABSTRACT

A foldable bag material is formed into a bag having at least one end with a corner and having an end closure formed by the bag material which closes off the one end of the bag. A filter valve tube extends within the end closure at the one corner, the tube having an inner end disposed within the interior of the bag such that the tube is adapted to receive a filler nozzle of a pneumatic filling device for filling the bag with a filling material. The tube has an inner end portion and an outer end portion, the inner end portion having a cross-sectional contraction which is contracted relative to the outer end portion such that the contracted inner end portion forms a seal with the filler nozzle, the tube being made at least partially of a filter material which is gas-permeable but which retains the filling material such that the gas-permeable material provides for venting of the bag during filling.

23 Claims, 2 Drawing Sheets

CROSS-BOTTOM OR BLOCK-BOTTOM VALVE SACK

BACKGROUND OF THE INVENTION

The invention relates to a cross-bottom or block bottom valve sack of paper, plastic film or a similar foldable material especially for dusty or powdery material that is to be filled, with a filler valve, which is incorporated in the region of a valve-forming corner fold in one of its two sack bottoms, which are bounded at the sides by bottom side fold lines, said filler valve having a filter valve tube, which consists of a filter material that is permeable to gas yet retains the particles of the material to be filled, protrudes at one end over the valve-forming corner fold into the interior of the sack and can be pushed onto a filler connection piece of a pneumatic filling device.

When filling cross-bottom or block-bottom valve sacks of the material described, which are practically impermeable to air, with dusty or powdery materials using pneumatic filling devices, difficulties arise owing to the fact that the air, forced into the sack together with the dusty or powdery material, cannot readily escape into the open because of the impermeability of the sack material.

In order to provide a remedy here, various embodiments have been proposed, in which perforations and similar vent openings are disposed in the sack material. Admittedly, these permit the air to escape from the sack during the filling process. However, in the reverse way, they enable moisture to penetrate through the sack material into the contents of the sack. This is unacceptable, especially in the case of hygroscopic sack contents, which are to be protected by a moisture-barrier layer, which is included in the sack material in order to improve the shelf life of the contents.

In a cross-bottom or block-bottom valve sack of the initially stated type, which has furthermore become known, it is admittedly possible to do without perforations in the sack material for the purpose of venting the sack, since the filler valve itself here, due to the use of filter material for the valve tube, can bring about a venting of the sack during the filling process over the filter valve tube. At the same time, however, it turned out that the filter valve tube, pushed onto the filler connection piece of the filling device for carrying out the filling process, cannot surround the filler connection piece tightly while the sack is being filled in such a manner that air cannot by-pass the filter material and escape from the sack through the annular gap between the inner circumference of the filter valve tube and the outer circumference of the filler connection piece. By so doing, considerable proportions of the dusty or powdery material that is to be filled is carried along to the outside under some circumstances. This can cause considerable inconvenience to the operators of the filling device. Even small amounts of such dusty or powdery material, which is carried along to the outside, are unacceptable in most cases, especially if it is a question of packing chemical products with a certain health risk.

SUMMARY OF THE INVENTION

It is therefore an object of the invention to provide a cross-bottom or block-bottom valve sack of the initially stated kind, with which, while omitting perforations and similar venting openings, reliable venting of the sack is achieved, especially during the filling process over the filter valve tube, dusting of the particles of the material being filled is reliably avoided.

Pursuant to the invention, this objective is accomplished by a development of the sack corresponding to the claims. Owing to the fact that, with this development, the filter valve tube is provided in its end region, which protrudes into the interior of the sack, with a cross sectional contraction tapering towards the inner end edge of the filter valve tube, the filter valve tube is constructed in its inner end region like a gasket, which acts like a clamping ring and which, when the valve sack is pushed onto the filler connection piece of the filling machine, holds the end of the filler connection piece with an appropriate conical taper so as to form a seal. In this manner, the compressed air, which has been carried into the interior of the sack together with the powdery and dusty material, is reliably discharged over the filter valve tube without permitting air, while carrying a long particles of the material being filled into the sack, to escape to the outside in an undesirable manner in the area between the inner circumference of the filter valve tube and the outer circumference of the filler connection piece. More particularly, the discharge of the air from the interior of the sack during the filling process can also take place through removal by suction by way of the filler connection piece of the filling machine, if this connection piece has, aside from an inner pipe for pneumatically filling the sack, a concentric outer mantle pipe, which is connected to a suction source and is provided in its outer circumferential wall with suction slits which, when the valve sack is attached to the filler connection piece, is overlapped by the region of the filter valve tube kept free of the cross sectional contraction. Under the action of suction, the filter valve tube is pulled against the mantle pipe, covering its suction slits so that the filter valve tube is a gas release means in that only the air is exhausted through the filter valve tube and the particles of the material being filled are retained in the interior of the sack and are reliably prevented in this way from dusting during the filling process.

As filter material for the filter valve tube, all suitable materials with the necessary gas or air permeability and the appropriate capability to retain particles of the material being filled, such as especially filter papers, as used to produce vacuum cleaner filter bags, are suitable.

The filter valve tube, instead of being formed from a one-piece blank of such a filter material, can also be constructed as half a tube, the other half of the tube consisting of normal material, impermeable to air. Depending on the conditions specified by the filler connection piece of the pneumatic filling device, the filter valve half-tube can be disposed either in the upper or in the lower half of the valve. The two material halves are connected essentially in a plane containing the longitudinal edges of the filter valve tube lying flat.

In some applications, the filtering effect can be improved further owing to the fact that the filter valve tube, outside of the area where it is connected to the bottom of the sack, has a microperforation, which extends at least over a part of the surface of the filter material. For the same purpose, the filter valve tube may also be provided in the region in which it protrudes into the interior of the sack additionally on its outside with a lining jacket of filter material. The filter material of the lining jacket may consist of the same material as the filter valve tube or of a different filter material, such as a nonwoven material.

The filter valve tube, through its region protruding over the valve-forming corner fold into the interior of the sack, forms as a so-called inner valve at the end of the filling process under the pressure of the material being filled an inner barrier, which counteracts leakage of material being filled through the valve tube, which is compressed together flat. On the other hand, to achieve a particular tight sealing of the valve channel at the completion of the filling process, it may be advisable to incorporate additionally in the outer region of the filter valve tube an outer sealing jacket with an inner layer, which is convertible from a normally nonadhesive state into an adhesive or sealable state tightly sealing the filler valve.

Numerous further characteristics and advantages of the invention arise out of the further dependent claims and the specification below in conjunction with the drawing, in which an example of the operation of the object of the invention is illustrated schematically.

DESCRIPTION OF THE PREFERRED EMBODIMENTS

Figure 1:
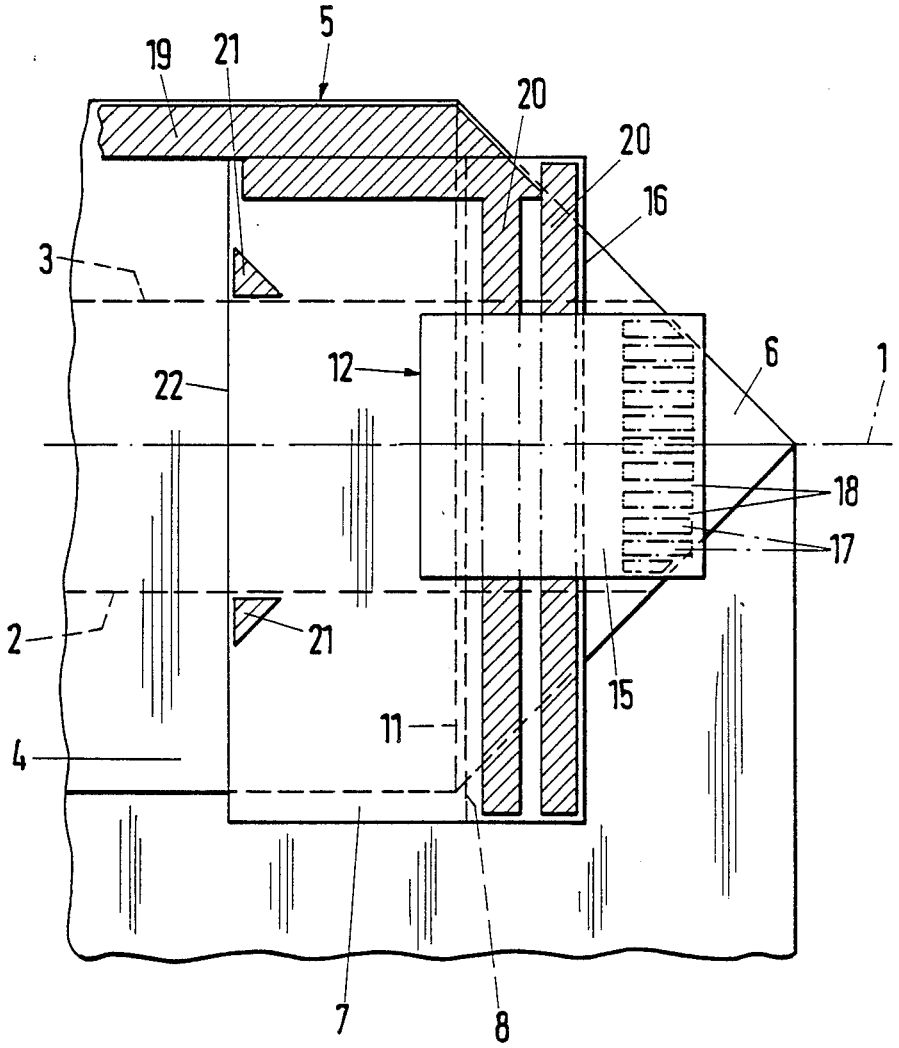
FIG. 1 shows a truncated plan view of the valve corner of the end of a sack workpiece pulled up on an open cross bottom.

In the example of the operation illustrated in the drawing, a single-layer cross-bottom valve sack of paper is shown. Its place can also be taken by cross-bottom valve sack of two or more layers of material. Instead of material layers consisting, for example, entirely of paper, it is also possible to use material layers containing paper, such as paper laminated with plastic film or metal foil as barrier layer or intermediate barrier layers of metal foil, plastic film or similar materials. Moreover, plastic films also come into consideration as the only sack material. When producing the cross bottom by gluing the materials, the material sides or layers consisting of paper are preferably used. They permit the use of starch-based adhesives, which are normally used for making paper sacks. When processing sack material comprising plastic films or plastic layers, welding or hot sealing, including hot-melt bonding can take the place of gluing to combine the layers of the sack material.

In the cross bottom, shown in the drawing with its valve corner, the bottom center rupture line is labeled 1 in FIG. 1, while the bottom side fold lines at 2 and 3 are each shown by a broken line. The bottom two side turn-ups are labeled 4 and 5. Of the two opposite corner folds, only the corner fold forming the valve labeled 6 is shown.

A material blank 7, corresponding to the representation in FIG. 1, is the first to be glued on the corner fold 6. The width of this material blank 7, measured transversely to the bottom center rupture line 1, exceeds twice the bottom width of the finished cross bottom, as is evident from the cross dimensions between the bottom side fold lines 2 and 3. The material blank 7 is the starting workpiece of the filter valve tube 7' (FIGS. 2 and 3) that is to be formed in the course of completing the cross bottom. It has a turn-up 8, which is folded over onto itself and with which it is glued onto the corner fold 6 with the help of two parallel, strip-shaped applications of glue 9 and 10. An inner ring-shaped pocket of the filter valve tube 7', which enlarges the filter surface, is formed by the turn-up 8. In the longitudinal direction, that is, in the direction of the bottom center break line 1, the material blank 7 protrudes over the inner edge 11 of the corner fold 6, so that the finished filter valve tube 7' has a region of tube, which protrudes into the interior of the sack.

An outer sealing jacket 12 is incorporated into the outer region of the filter valve tube 7' lying above the corner fold 6. This outer sealing jacket 12 is glued in the open cross bottom of FIG. 1 with the help of glue applications 13 and 14 on the material blank lying flat in the region between the bottom side fold lines 2 and 3. The width of the outer sealing jacket corresponds essentially to the width of the finished cross bottom; in matching the valve channel diameter, which is specified by the width of the filter valve tube 7', the width may also be smaller than the width of the bottom. The outer sealing jacket 12 has an inner layer of thermoplastic material, which can be transformed from a normally non-adhesive state by the application of heat into a gluable or sealable state suitable for tightly sealing the filling valve. The outer sealing jacket is glued with an external projection 15 over the adjoining end edge 16 of the material blank 7 on the corner fold 6 with the help of an application of glue 17, the air passage channels 18 from the interior of the sack or the filter valve tube 7' to the outside of the sack being retained.

To close the cross bottom by folding the bottom side turn-ups 4 and 5 inwards about the bottom side fold lines 2 and 3, a glue format is applied on the open cross bottom according to FIG. 1. This glue format application comprises a longitudinal application 19, which runs in the longitudinal direction of the bottom, and a transverse application of glue 20, which runs transversely to the former direction. The glue applications 19 and 20, as well as the remaining glue applications, are represented by cross hatching in FIGS. 1 and 2 and by small circles in FIG. 3. Owing to the fact that the glue application 19 includes not only the bottom side turn-up 5, but also the adjoining edge region of the material blank 7, the filter valve tube 7' is connected in a corresponding length region of its part protruding over the corner fold edge 11 into the interior of the sack firmly with the bottom side turn-up 4, after this, to close the bottom, is the first to be folded inwards and then the bottom side turn-up 5 is folded over this. At the same time, with the help of the glue application 19, the material blank 7 is also closed with the formation of a longitudinal seam to the valve tube 7'. The inner part of the valve tube 7' thus is not freely movable, but fixed to the bottom of the sack. This immobilization can also be brought about in other ways, for example, by gluing the material blank 7 in its regions outside of the bottom side fold lines 2, 3 with the bottom side turn-ups 4, 5. In this way the valve tube 7' occupies also in its inner region a defined position, thus preventing the inner part of the valve tube being pulled out by any residual suction effect of the filler connection piece when the sack is released.

However, before the bottom side turn-ups 4, 5 are closed, taking along the adjacent sides of the material blank 7, two glue applications 21 are applied on the upper side of the material blank 7 in the cross bottom of FIG. 1, which has been laid flat. In the example shown, the glue applications 21 in each case have the shape of a right triangle, the legs of which adjoin the inner end edge 22 of the material blank 7 and the adjacent bottom side fold line 2 or 3 in the region in the region of the respective bottom side turn-up 4 or 5. After the inwards folding of the bottom side turn-ups 4 and 5 and the therewith associated conversion of the flat material blank 7 into the filter valve tube 7', the hypotenuses of the triangular glue applications 21 in each case are facing one another and converging towards the inner end edge 22 of the filter valve tube 7', as can be seen especially in FIG. 2.

Figure 2:
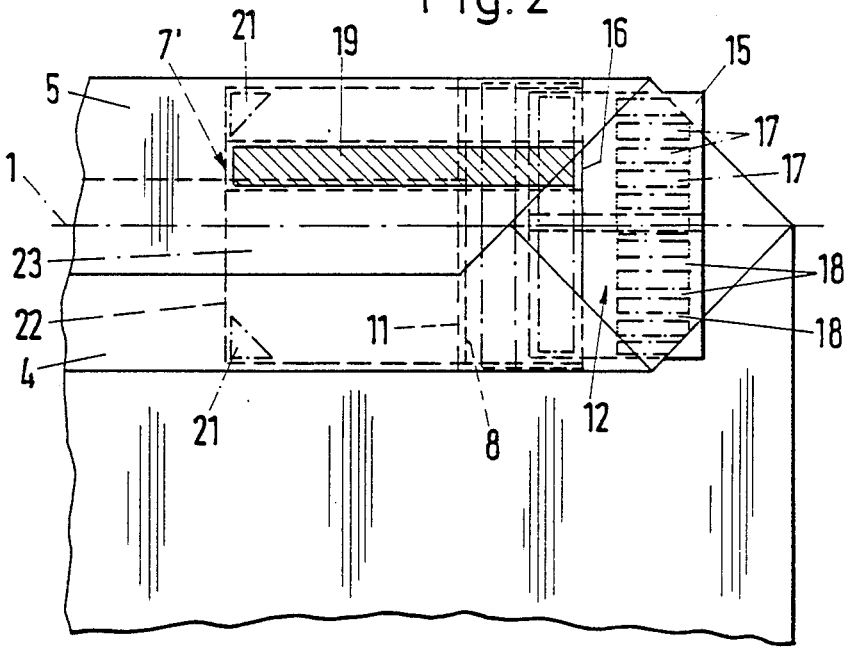
FIG. 2 shows a view corresponding to FIG. 1; however, the cross bottom of the sack workpiece is closed to a finished cross bottom.

Through the glue applications 21, a cross sectional contraction 23 of the free valve channel is formed in the end region of the filter valve tube 7' that protrudes into the interior of the sack. Based on the flat-lying state of the filter valve tube 7', as shown in FIG. 2, this cross sectional contraction 23 has the basic shape of a symmetrical trapezium, which lies in the plane occupied by the longitudinal edges of the filter valve tube 7' defined by the bottom side fold lines 2, 3. The shorter of the two parallel sides of the trapezium essentially terminates flush with the inner end edge 22 of the filter valve tube 7'. When pushing the filter valve tube 7' on the filler connection piece of a filling device, the flat-lying filter valve tube 7' is expanded to an essentially cylindrical shape in the predominant portion of its length, while in its inner end region the cross sectional contraction 23, which is trapezoidal in the flat-lying state of the filter valve tube 7', assumes a filter-shaped form and lies tightly against the corresponding conical end of the filler connection piece with friction contact.

Figure 3:
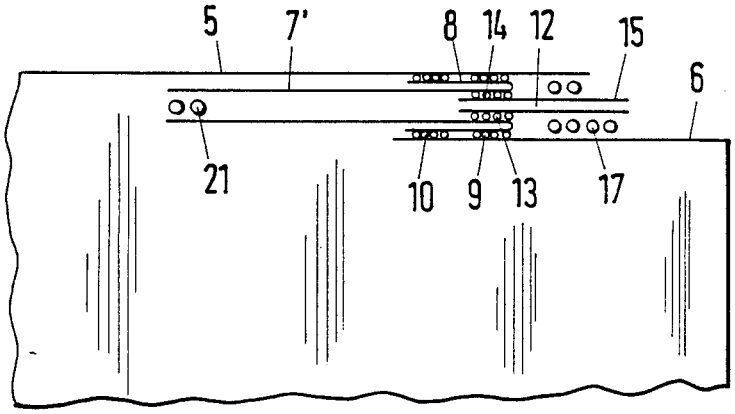
FIG. 3 shows a vertical section through the valve corner of the cross bottom of FIG. 2.

The cross bottom shown in FIGS. 2 and 3 and formed by folding the bottom side turn-ups 4 and 5 inwards, may have as external end a bottom cover sheet (not shown), which is glued onto the outside of the bottom side turn-ups 4, 5. In the region of the valve-forming corner fold 6, the dimensions of the cover sheet are such, that it essentially terminates flush with the external sealing jacket 12. At the same time, air passage channels form the interior of the sack or from the filter valve tube 7' to the outside of the sack corresponding to air passage channels 18 can be left in the glued joint between the bottom cover sheet and the adjacent layer of the outer sealing jacket, in order to make further venting of the filled sacks possible after the filling process. In this connection, it is, for example, possible to construct the bottom cover sheet from an air-permeable material, which is different from that of the rest of the sack.

Due to the external projection 15 relative to the filter valve tube 7', a wicking effect of its filter material is largely avoided, so that moisture absorption from the outside by way of the filter material essentially is precluded even during prolonged storage of the filled sack.

What we claim is:

1. A bag comprising a foldable bag material formed into a bag having at least one end with a corner, end closure means formed by said bag material and closing off said one end of said bag, a filter valve tube means extending within said end closure means at said one corner, said tube means having an inner end disposed within the interior of said bag such that said tube means is adapted to receive a filler nozzle of a pneumatic filling device for filling said bag with a filling material, said tube means having an inner end portion and an outer end portion, said inner end portion having a cross-sectional contraction which is contracted relative to said outer end portion such that said contracted inner end portion forms a seal with said filler nozzle, said tube means comprising gas release means in the form of a filter material which is gas-permeable but which retains the filling material such that said gas release means is operable to provide for the escape of gases from the bag during filling of the bag while retaining said filling material within the bag.

2. A bag according to claim 1, wherein said bag is a cross-bottom or block bottom made from a foldable material selected from the group consisting of paper and plastic.

3. A bag according to claim 1, wherein said tube means has a collapsed flat state formed by two superimposed flat layers of material, and securing means securing parts of said two superimposed flat layers to form said contracted inner end portion.

4. A bag according to claim 3, wherein said two superimposed flat layers have two longitudinal edges and an inner edge, said securing means extending to parts of each longitudinal edge and to parts of said inner edge.

5. A bag according to claim 3, wherein said securing means comprises an adhesive.

6. A bag according to claim 1, wherein said closure means comprises side turn-ups and a corner fold at said corner, said tube means extending into the interior of said bag beyond said corner fold.

7. A bag according to claim 1 further comprising securing means securing said tube means to said end closure means.

8. A bag according to claim 1, wherein said outer portion of said tube means has a turn-up which is folded over on itself, and securing means securing said turn-up to said bag material.

9. A bag according to claim 1, wherein said tube means is made partially of said gas-permeable filter material and partly of a gas-impermeable material.

10. A bag according to claim 1, wherein said tube means is formed from one piece of said gas-permeable filter material.

11. A bag according to claim 1, wherein said tube means has an inner section which protrudes into the interior of said bag and a lining jacket of filter material on said inner section.

12. A bag according to claim 1, wherein said tube means has an outer section, and a sealing means in said outer section of said tube means for sealing off said tube means.

13. A bag according to claim 12, wherein said sealing means comprises a sealing jacket and an adhesive which is normally non-adhesive but which is convertible into an adhesive state for sealing off said tube means.

14. A bag according to claim 13 further comprising securing means securing said sealing jacket to said tube means.

15. A bag according to claim 13, wherein said closure means comprises side turn-ups and a corner fold at said corner, said sealing jacket having an outer section extending externally of said tube means and being in superimposed relationship with said corner fold.

16. A bag according to claim 15 further comprising securing means securing said sealing jacket to said corner turn-in.

17. A bag comprising a foldable bag material formed into a bag having at least one end with a corner, end closure means formed by said bag material and closing off said one end of said bag, a filter valve tube means extending within said end closure means at said one corner, said tube means having an inner end disposed within the interior of said bag such that said tube means is adapted to receive a filler nozzle of a pneumatic filling device for filling said bag with a filling material, said tube means having an inner end portion and an outer end portion, said inner end portion having a cross-sectional contraction which is contracted relative to said outer end portion such that said contracted inner end portion forms a seal with said filler nozzle, said tube means being made at least partially of a filter material which is gas-permeable but which retains the filling material such that said gas-permeable material provides for venting of the bag during filling, said tube means having a collapsed flat state formed by two superimposed flat layers of material, said two superimposed flat layers having two longitudinal edges and an inner edge, and securing means securing parts of said two superimposed flat layers to form said contracted inner end portion, said securing means extending to parts of each longitudinal edge and to parts of said inner edge, said tube means having an axial center line, said securing means having right triangular configurations with the hypotenuses of each triangular configuration approaching said axial center line as said inner edge is approached.

18. A bag according to claim 17, wherein each of said triangular configurations has one side contiguous with one of said longitudinal edges and the other side contiguous with said inner edge.

19. A bag comprising a foldable bag material formed into a bag having at least one end with a corner, end closure means formed by said bag material and closing off said one end of said bag, a filter valve tube means extending within said end closure means at said one corner, said tube means having an inner end disposed within the interior of said bag such that said tube means is adapted to receive a filler nozzle of a pneumatic filling device for filling said bag with a filling material, said tube means having an inner end portion and an outer end portion, said inner end portion having a cross-sectional contraction which is contracted relative to said outer end portion such that said contracted inner end portion forms a seal with said filler nozzle, said tube means being made at least partially of a filter material which is gas-permeable but which retains the filling material such that said gas-permeable material provides for venting of the bag during filling, said tube means having an outer section, a sealing means in said outer section of said tube means for sealing off said tube means, said sealing means comprises a sealing jacket and an adhesive which is normally non-adhesive but which is convertible into an adhesive state for sealing off said tube means, said closure means comprises lateral turn-overs and a corner turn-in at said corner, said sealing jacket having an outer section extending externally of said tube means and being in superimposed relationship with said corner turn-in, a cover sheet secured to said lateral turn-overs, said cover sheet having an outer end section disposed in superimposed relationship relative to said sealing jacket.

20. A bag according to claim 19, wherein said securing means comprises securing parts spaced from one another, the spaces between said spaced securing parts providing air passage channels.

21. A bag comprising a foldable bag material formed into a bag having at least one end with a corner, end closure means formed by said bag material and closing off said one end of said bag, a filter valve tube means extending within said end closure means at said one corner, said tube means having an inner end disposed within the interior of said bag such that said tube means is adapted to receive a filler nozzle of a pneumatic filling device for filling said bag with a filling material, said tube means having an inner end portion and an outer end portion, said inner end portion having a cross-sectional contraction which is contracted relative to said outer end portion such that said contracted inner end portion forms a seal with said filler nozzle, said tube means being made at least partially of a filter material which is gas-permeable but which retains the filling material such that said gas-permeable material provides for venting of the bag during filling, said tube means having an outer section, and a sealing means in said outer section of said tube means for sealing off said tube means, said sealing means comprises a sealing jacket and an adhesive which is normally non-adhesive but which is convertible into an adhesive state for sealing off said tube means, said closure means comprising lateral turn-overs and a corner turn-in at said corner, said sealing jacket having an outer section extending externally of said tube means and being in superimposed relationship with said corner turn-in, and further comprising securing means securing said sealing jacket to said corner turn-in, said securing means comprising securing parts spaced from one another, the spaces between said spaced securing parts providing air passage channels.

22. A bag comprising a foldable bag material formed into a bag having at least one end with a corner, end closure means formed by said bag material and closing off said one end of said bag, said closure means having lateral turn-overs and a corner turn-in at said corner, a filter valve tube means extending within said end closure means at said one corner, said tube means having an inner end portion disposed within the interior of said bag and extending from said corner turn-in, said tube means also having an outer portion leading to the exterior of said bag such that said tube means is adapted to receive a filler nozzle of a pneumatic filling device for filling said bag with a filling material, an elongated adhesive means extending along the axial length of said inner tube portion and disposed between said inner tube portion and said closure means to thereby adhesively secure said inner tube section to said closure means, said inner end section having an end part which has a cross-sectional contraction which is contracted relative to said outer end portion such that said contracted inner end portion forms a seal with said filler nozzle, said tube means being made at least partially of a filter material which is gas-permeable but which retains the filling material such that said gas-permeable material provides for venting of the bag during filling.

23. A bag comprising a foldable bag material formed into a bag having at least one end with a corner, end closure means formed by said bag material and closing off said one end of said bag, a filter valve tube means extending within said end closure means at said one corner, said tube means being made of a material different from said bag material, adhesive means adhesively securing said tube means to said end closure means, said tube means having an inner end disposed within the interior of said bag such that said tube means is adapted to receive a filler nozzle of a pneumatic filling device for filling said bag with a filling material, said tube means having an inner end portion and an outer end portion, said inner end portion having a cross-sectional contraction which is contracted relative to said outer end portion such that said contracted inner end portion forms a seal with said filler nozzle, said tube means being made at least partially of a filter material which is gas-permeable but which retains the filling material such that said gas-permeable material provides for the escape of gases from the bag during filling of the bag through openings on the outside of said filler nozzle.

* * * * *